US009392644B2

(12) United States Patent
Nojiri et al.

(10) Patent No.: US 9,392,644 B2
(45) Date of Patent: Jul. 12, 2016

(54) ENERGIZATION HEATING DEVICE AND METHOD

(75) Inventors: Isao Nojiri, Nisshin (JP); Shinji Ishii, Aichi-gun (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 14/129,662

(22) PCT Filed: Jul. 19, 2011

(86) PCT No.: PCT/JP2011/066326

§ 371 (c)(1),
(2), (4) Date: Dec. 27, 2013

(87) PCT Pub. No.: WO2013/011553

PCT Pub. Date: Jan. 24, 2013

(65) Prior Publication Data

US 2014/0123722 A1 May 8, 2014

(51) Int. Cl.

| | |
|---|---|
| ***H05B 3/02*** | (2006.01) |
| ***B21D 37/16*** | (2006.01) |
| ***C21D 1/40*** | (2006.01) |
| ***H05B 3/03*** | (2006.01) |
| ***C21D 7/13*** | (2006.01) |
| ***C21D 8/00*** | (2006.01) |
| ***H05B 3/00*** | (2006.01) |

(52) U.S. Cl.

CPC ..... *H05B 3/023* (2013.01); *B21D 37/16* (2013.01); *C21D 1/40* (2013.01); *C21D 7/13* (2013.01); *H05B 3/0004* (2013.01); *H05B 3/03* (2013.01); *C21D 2261/00* (2013.01)

(58) Field of Classification Search

CPC ..... C21D 1/40; C21D 9/46; C21D 1/34; B21D 37/16; B21D 22/02; B21D 11/02; B21D 11/22; H05B 3/0004; H05B 3/023; H05B 2203/016; H05B 3/0023; H05B 3/03

USPC ..... 72/342.1, 342.7, 342.8, 342.94, 342.96; 219/50, 149, 154–156, 161, 162, 494, 219/200; 148/688, 567, 691

See application file for complete search history.

(56) References Cited

U.S. PATENT DOCUMENTS 3,933,020 A * 1/1976 Orr et al. ..... 72/297
6,033,499 A * 3/2000 Mitra ..... B21D 11/18 148/688

(Continued)

FOREIGN PATENT DOCUMENTS

JP A-3-180221 8/1991
JP WO/2009/075133 * 9/2008

(Continued)

*Primary Examiner* — Peter DungBa Vo
*Assistant Examiner* — John Lowe
(74) *Attorney, Agent, or Firm* — Oliff PLC

(57) ABSTRACT

An electrically heating device is provided with a pair of clamp units serving as electrodes for energization and applying tension to a workpiece to be heated clamped between the clamp units by moving the clamp units in the direction in which the clamp units separate from each other during energization heating. The clamp units each include a facing surface inclined with respect to the moving direction of the clamp units and form, by the facing surface, a preform including an inclined surface inclined with respect to the plane direction of the workpiece in a clamping portion clamped between the clamp units in the workpiece.

3 Claims, 6 Drawing Sheets

(56) References Cited

U.S. PATENT DOCUMENTS

| | | | | |
|---|---|---|---|---|
| 6,463,779 | B1 * | 10/2002 | Terziakin | 72/342.96 |
| 2010/0269559 | A1 * | 10/2010 | Ishiguro | C21D 1/673 72/342.1 |

FOREIGN PATENT DOCUMENTS

| | | | |
|---|---|---|---|
| JP | A-2009-142854 | | 7/2009 |
| WO | WO 2009075133 | A1 * | 6/2009 |

* cited by examiner

ENERGIZATION HEATING DEVICE AND METHOD

TECHNICAL FIELD

The present invention relates to a device and method for electrically heating, or heating by passing electricity through a steel plate.

BACKGROUND ART

In a conventional technique, e.g., in JP 2009-142854 A, a pair of clamping units as energizing electrodes clamps a workpiece at both ends from vertical direction to electrically heat the workpiece. During the electrical heating, the clamping units move in a separating direction from each other in order to apply a tension to the workpiece, whereby the workpiece can avoid a warp caused by expansion of the material.

JP 2009-142854 A also discloses a structure including multiple pins disposed below the middle of the workpiece, in which the pins support the workpiece under heating to prevent sagging.

CITATION LIST

Patent Literature

PTL 1: JP 2009-142854 A

SUMMARY OF INVENTION

Technical Problem

The technique of JP 2009-142854 A is able to prevent the warp of the workpiece by moving the clamping units clamping the workpiece.

To ensure heating accuracy in the energization heating, it is preferable to minimize a contact area between the electrode and the workpiece and to prevent occurrence of electric current distribution. However, if the clamping units clamp the workpiece with small contact area, there may occur a slip between the surface of the electrode and the workpiece during the clamping units pull the workpiece. If the clamping units clamp the workpiece with large force to avoid the slip, a large friction force occurs between the surface of the electrode and the workpiece, so that the electrode may be worn.

The present invention relates to a device for electrically heating a workpiece including a pair of clamping units serving as energizing electrodes which move in a separating direction from each other during the electrical heating, and aims to provide a technique of sufficiently clamping the workpiece by the electrodes and of ensuring a uniform contact between the electrodes and the workpiece.

Technical Solutions

First aspect of the present invention relates to a device for electrically heating device including a pair of clamping units serving as energizing electrodes, wherein the pair of clamping units move in a separating direction from each other during the electrical heating so as to apply a tension to a workpiece to be heated clamped by the pair of clamping units. Each of the clamping units includes a facing surface inclined with respect to a moving direction of the clamping unit, and the facing surface forms a preform including a surface inclined to a plane direction of the workpiece at a clamping portion of the workpiece where the clamping unit clamps.

In a preferable embodiment, the clamping unit includes: an electrode including the facing surface and being movable in approaching and separating directions from the workpiece; and a fixed table and a movable table on which the workpiece is mounted, and both of which face the electrode through the workpiece, the electrode includes a step portion protruding downward from a bottom thereof, the step portion including the facing surface at a wall thereof, the movable table is movable following the electrode, and when the electrode moves in the approaching direction, the movable table moves relatively to the fixed table, whereby a step is formed therebetween, and when the clamping unit clamps the workpiece, the step portion of the electrode and the step between the fixed table and the movable table bend the workpiece and form the preform.

In an alternative embodiment, the clamping unit includes: an electrode including the facing surface and being movable in approaching and separating directions from the workpiece; and a mounting table facing the electrode through the workpiece, on which the workpiece is mounted, the electrode includes a projection protruding downward from a bottom thereof, the mounting table comprises a recess having a shape corresponding to the projection, and when the clamping unit clamps the workpiece, the projection and the recess bend the workpiece and form the preform.

Second aspect of the present invention relates to a method for electrically heating a workpiece to be heated, using a device for electrically heating comprising a pair of clamping units serving as energizing electrodes, wherein the pair of clamping units move in a separating direction from each other during the electrical heating so as to apply a tension to the workpiece clamped by the pair of clamping units. The method includes forming a preform including a surface inclined to a plane direction of the workpiece at a clamping portion of the workpiece where the clamping unit clamps, when the clamping unit clamps the workpiece.

Advantageous Effects of Invention

According to the invention, within the device for electrically heating the workpiece including the pair of clamping units serving as energizing electrodes which move in the separating direction from each other during the electrical heating, the technique of sufficiently clamping the workpiece by the electrodes and of ensuring the uniform contact between the electrodes and the workpiece can be provided.

DESCRIPTION OF EMBODIMENTS

Figure 1:
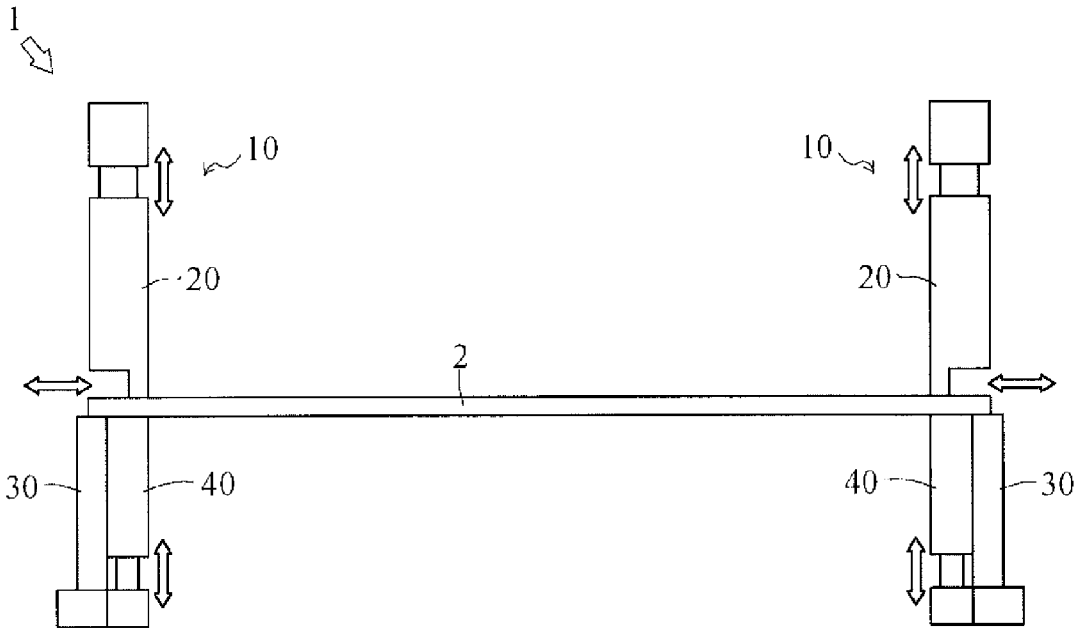
FIG. 1 depicts an electrical heating device.

As shown in FIG. 1, an electrical heating device 1 is used for heating a workpiece 2 to be heated by energizing the workpiece. The workpiece 2 is a steel plate having a rectangular shape.

The electrical heating device 1 supports the workpiece 2 by clamping both longitudinal ends thereof, and energizes the workpiece 2 between the clamping portions. In the electrical heating device 1, the workpiece 2 is set as the thickness direction is vertical direction, and electricity passes along longitudinal direction.

Noted that the clamping portions for the workpiece 2 by the electrical heating device 1 are not limited to the ends of the workpiece 2, and the clamping portions may be set in accordance with any embodiment of electrically heating.

The electrical heating device 1 includes a pair of clamping units 10. The clamping units 10 are located at the longitudinal ends of the workpiece 2, and arranged line symmetrically with respect to the center line of the workpiece 2.

The clamping units 10 clamp the workpiece 2 from the vertical direction, and energize the workpiece 2. Each of the clamping units 10 includes a moving device, and is configured being movable in a separating direction from the other.

The clamping units 10 move in the separating direction from each other, with energizing the workpiece 2, and thus a warp caused by thermal expansion of the material is prevented. In other words, the clamping units 10 move along the plane direction (the longitudinal direction) of the workpiece 2 such that each of the clamping units moves from center to end of the workpiece. Thus, the distance between the clamping units 10 become longer, and a tension is applied to the workpiece 2 supported by the clamping units 10, so that the warp of the workpiece can be avoided.

As depicted in FIG. 1, the clamping unit 10 includes an electrode 20 movable in the vertical direction, a fixed table 30 on which the workpiece 2 is mounted, and a movable table 40 movable following the vertical movement of the electrode 20. The electrode 20 is arranged above the workpiece 2, and the fixed table 30 and the movable table 40 are arranged below the workpiece 2. The workpiece 2 is mounted on the fixed table 30 and the movable table 40, and clamped by the electrode 20 from the upper direction, thereby clamping the workpiece 2 from the vertical direction.

The electrode 20 is actuated in the vertical direction by a suitable actuator and moves in approaching direction and separating direction from the upper surface of the workpiece 2. The electrode 20 is made of a conductive material and connected to a power supply. The power supply applies a voltage between the electrodes 20 to pass electricity through the workpiece 2 from contact areas between the workpiece 2 and the electrodes 20.

In the pair of clamping units 10, one of the electrodes 20 is used as a positive electrode and the other electrode 20 is used as a negative electrode, and the voltage is applied to each of the electrodes 20 to energize the workpiece 2.

The fixed table 30 has a flat top on which the workpiece 2 is mounted. The fixed table 30 supports one end of the workpiece 2. In detail, the end of the workpiece 2 is located in the center of the fixed table 30.

The fixed table 30 is fixed to the clamping unit 10 unmovably in the vertical direction. It should be noticed that the fixed table is movable in the longitudinal direction of the workpiece 2 with the movement of the clamping unit 10.

The movable table 40 has a flat top, and works as a table on which the workpiece 2 is mounted, same as the fixed table 30. The movable table 40 is disposed more inside of the workpiece 2 than the fixed table 30 and adjacent thereto, and thus supports inside of the end of the workpiece 2. The movable table 40 is supported by the clamping unit 10 via a suitable actuator.

The movable table 40 is movable in the vertical direction and follows the movement of the electrode 20. When the electrode 20 moves downward to clamp the workpiece 2, the movable table moves downwardly under the downward pressure of the electrode 20. On the contrary, after the energization heating for the workpiece 2, the clamp by the electrode 20 is released, and the movable table 40 moves upwardly following the upward movement of the electrode 20.

As described above, when the workpiece 2 is set on the clamping units 10, the workpiece is mounted on the fixed table 30 and movable table 40, and the electrodes 20 press the workpiece 2. Then, the workpiece 2 is clamped between the electrodes 20, the fixed tables 30 and the movable tables 40.

Figure 2:
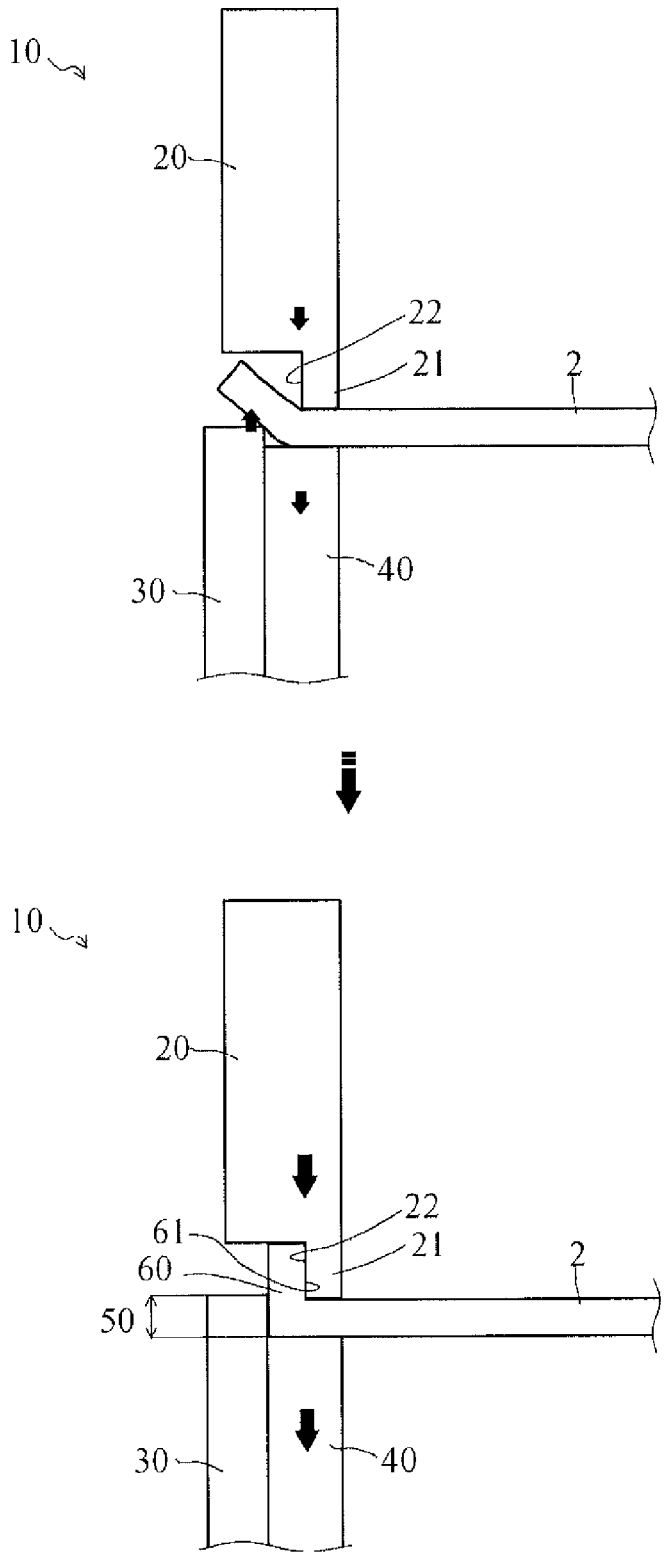
FIG. 2 illustrates a preforming by the electrical heating device.

As depicted in FIG. 2, the electrode 20 includes a step portion 21 formed at the bottom. The step portion 21 is formed in the whole width of the electrode 20. The step portion 21 is located at the center side of the workpiece 2, and protrudes downwardly from the edge of the electrode. In other words, the electrode 20 has the bottom with a step shape, which is formed by the step portion 21.

The step portion 21 includes a facing surface 22 standing upward from the lower bottom of the electrode 20. The facing surface 22 is formed as an outer wall of the step portion 21, or a wall in the end side of the workpiece 2. The facing surface 22 is inclined against the moving direction of the clamping units 10, and thus is formed as a surface inclined to the plane direction of the workpiece 2. That is, the facing surface 22 is able to add a resistance against the moving direction of the clamping units 10. In the present embodiment, the facing surface 22 is a surface perpendicular to the plane direction of the workpiece 2, and formed along the width direction of the workpiece 2.

As shown in FIG. 2, moving the electrode 20 downwardly, the downward pressure is added to the workpiece 2 and the movable table 40 moves downwardly together with the workpiece 2. The height of the fixed table 30 does not change, so that there is a step 50 between the mounting surface of the movable table 40 and that of the fixed table 30.

To the end of the workpiece 2 moving downwardly under the pressure from the electrode 20, the upward pressure is added by the fixed table 30, whereby the end of the workpiece is bent following the shape formed by the step 50 and the step portion 21 of the electrode 20. Thus, the end of the workpiece 2 is bent and formed in the step shape.

As described above, when the clamping unit 10 clamps the workpiece 2 among the electrode 20, the fixed table 30 and the movable table 40, or when performing the electrical heating, the end of the workpiece 2 is preformed.

Here, at the end of the workpiece 2, the step portion 21 and the step 50 form a preform 60 which is perpendicular to the plane direction of the workpiece 2. In other words, the end of the workpiece 2 is formed with the preform 60 including an inclined surface 61 inclined to the moving direction of the clamping units 10 during the electrical heating. The inclined surface 61 is a surface extended along the vertical direction formed in the end of the workpiece 2, and formed along the facing surface 22 of the electrode 20.

Figure 3:
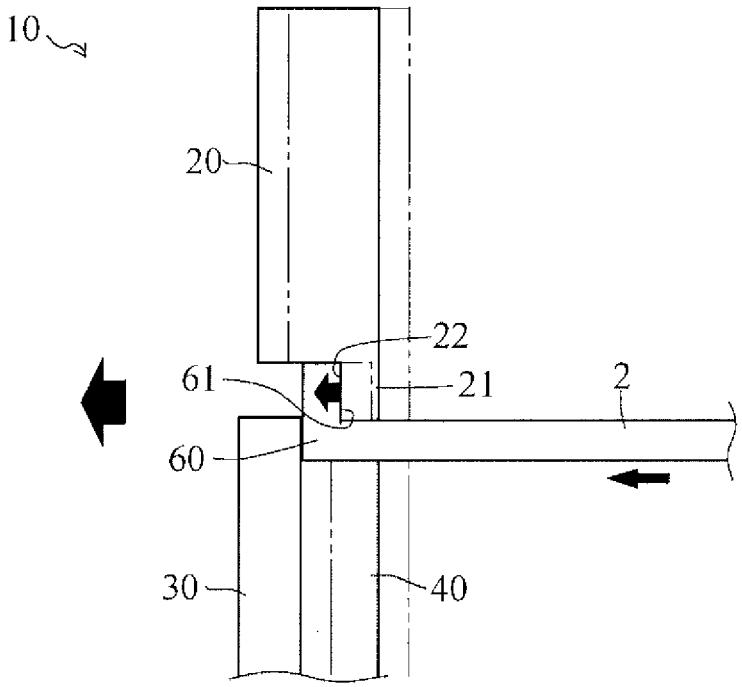
FIG. 3 illustrates an electrically heating by the electrical heating device.

As depicted in FIG. 3, after starting the electrical heating for the workpiece 2 by applying the voltage to the electrodes 20, temperature of the workpiece 2 rises.

In response to the temperature rising of the workpiece 2, the clamping units 10 move in the separating direction from each other, thereby adding the tension in the plane direction of the workpiece 2 so as to prevent the warp caused by the material expansion.

The workpiece 2 is formed with the preforms 60 at the both ends thereof, which are bent from the end toward the center, and therefore, the force in the moving direction of the clamping units 10 is transmitted to the inclined surfaces 61 of the workpiece 2 from the facing surfaces 22 of the electrodes 20. In other words, in the workpiece 2, the inclined surface 61 of the preform 60 works as a surface receiving the force.

As described above, the applying direction of the tension to the workpiece 2 is the same as the moving direction of the clamping units 10, so that the embodiment does not utilize the pulling force by the friction against the surface of the workpiece 2. As a result, occurrence of a large friction force between the electrodes 20 and the surface of the workpiece 2 can be prevented, and the electrodes 20 can avoid wear. Moreover, the uniform contact between the electrodes 20 and the workpiece 2 can be ensured, and therefore the heating accuracy can be ensured.

Figure 4:
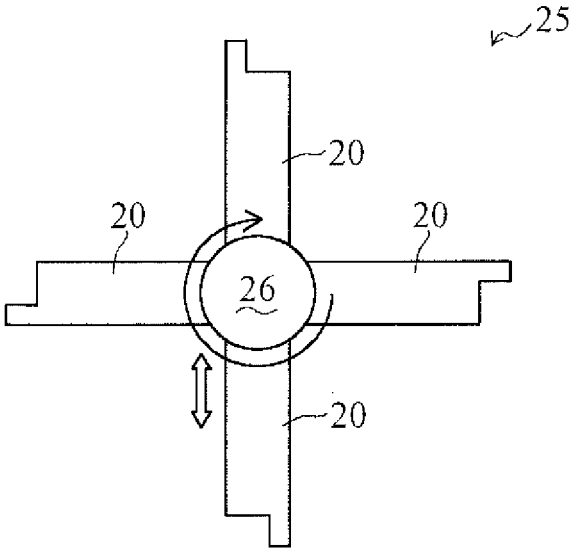
FIG. 4 depicts a preferable embodiment of electrodes.

Referring to FIG. 4, a preferable embodiment of the electrode is described below.

As illustrated in FIG. 4, as the electrode of the clamping unit 10 is preferably configured as a group of electrodes 25 including multiple electrodes 20. For example, the group of electrodes 25 includes a rotation shaft 26 movable in the vertical direction, around which four electrodes 20 are arranged in the circumferential direction at even intervals. In such structure, the electrode 20 used for clamping the workpiece 2 is the electrode 20 located under the rotation shaft 26.

Thus, multiple electrodes 20 having same structure are prepared around the rotation shaft 26, so that if a defect occurs on one electrode 20, that electrode 20 can be easily changed to the other electrode 20 by rotating the shaft 26, and therefore the productivity can be improved.

Figure 5:
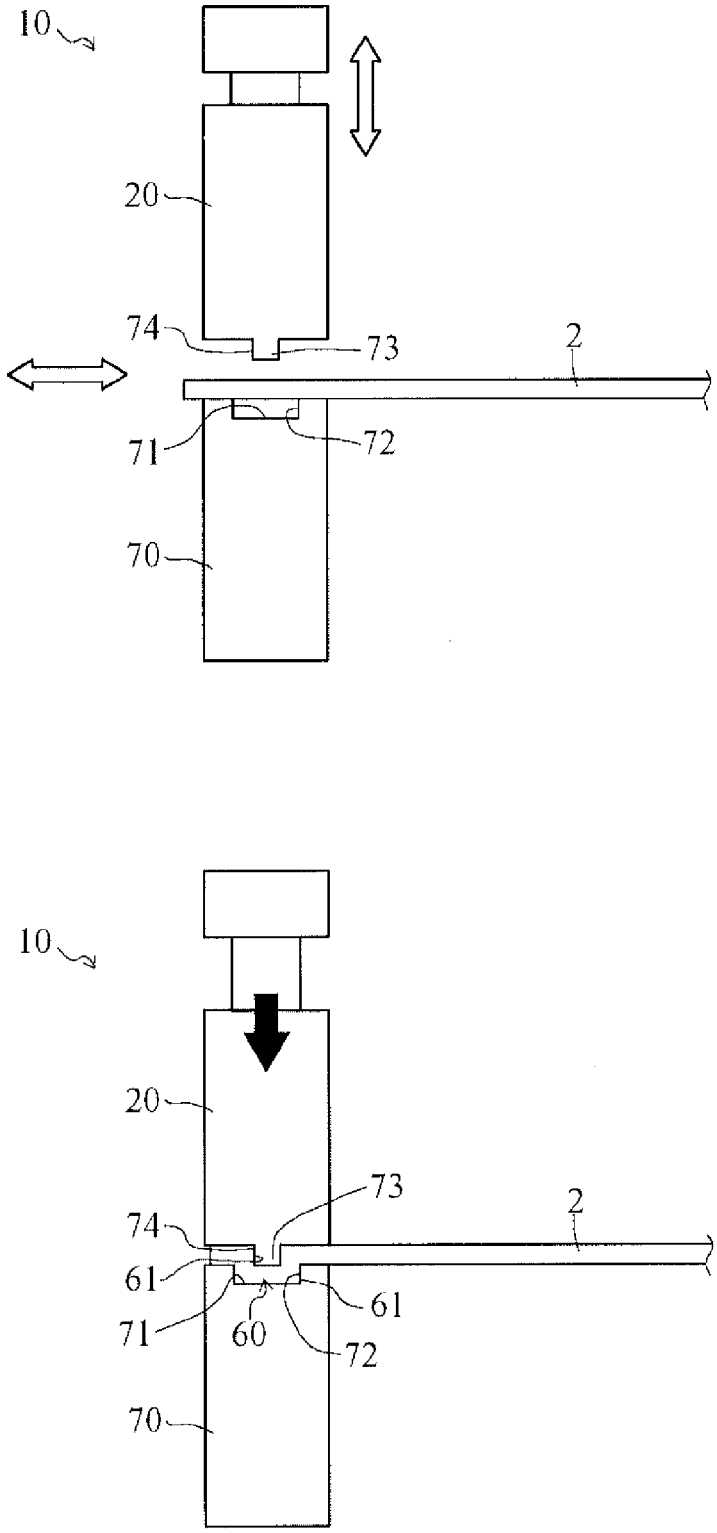
FIG. 5 depicts an alternative embodiment of clamping units.
Figure 6:
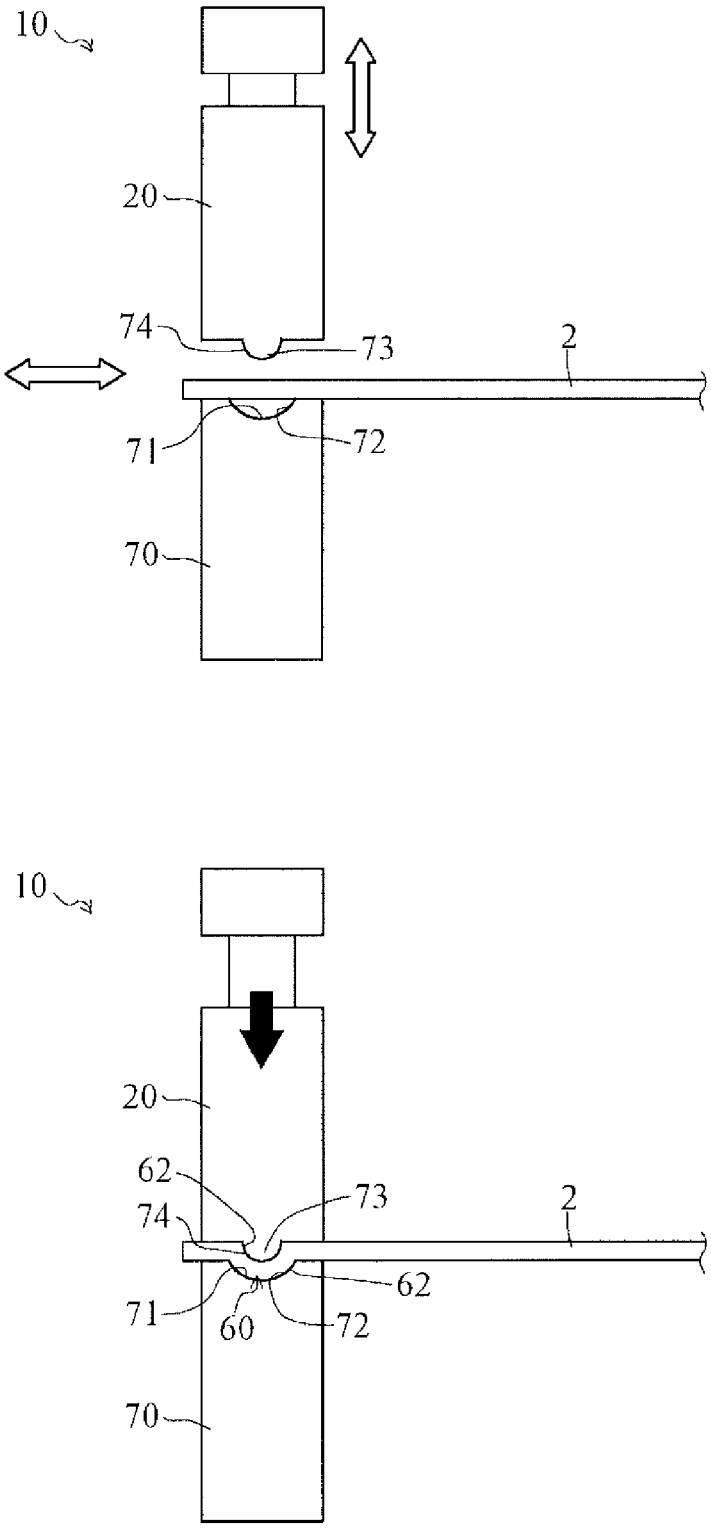
FIG. 6 depicts other preferable embodiment of the clamping units.

Referring to FIGS. 5 and 6, alternative embodiments of the clamping unit are described below.

As illustrated in FIG. 5, the clamping unit includes a mounting table 70 substituting for the fixed table 30 and the movable table 40. That is, in the embodiment, the table mounting the workpiece 2 composed of two members is replaced with the mounting table 70 composed of single member.

The mounting table 70 includes a recess 71 at the center of the top. The recess 71 is a groove having a rectangular section, which is formed along the width direction. The recess 71 is depressed downward from the top of the mounting table 70, and includes a facing surface 72 as an inner wall (in the side of the end of the workpiece 2). The flat surface apart from the recess 71 of the mounting table 70 is used for mounting the workpiece 2.

The electrode 20 includes a projection 73 with a shape corresponding to the recess 71 substituting for the step portion 21. The projection 72 is formed along the width direction of the electrode 20 and having a rectangular section. The outer wall (in the center side in the longitudinal direction of the workpiece 2) of the projection 73 is formed as a facing surface 74.

The electrodes 20 move toward the workpiece 2 mounted on the mounting tables 70 and press the workpiece, and the workpiece 2 is clamped between the electrodes 20 and the mounting tables 70, at the same time, each end of the workpiece 2 is pressed and bent in a crank shape by the recess 71 and the projection 73, thereby forming the preform 60 at the end of the workpiece 2.

Thus, the recess 71 of the mounting table 70 and the projection 73 of the electrode 20 also form the preform 60 at the end of the workpiece 2. Moreover, the preform 60 in this embodiment is formed with two inclined surfaces 61 by the facing surface 72 of the recess 71 and the facing surface 74 of the projection 73, so that the clamping force of the electrode 20 and the mounting table 70 can be increased.

Furthermore, the mounting table 70 can be simply configured, thereby reducing equipment cost.

As shown in FIG. 6, the recess 71 and the projection 73 may be formed in curve shapes. In this case, the recess 71 is formed as a semicircular groove, and the projection 73 is formed as a semicircular protrusion. The recess 71 and the projection 73 form the preform 60. That preform 60 includes two inclined surfaces 62 having curvature with respect to the plane direction of the workpiece 2.

Thus, the preforming shape of the end of the workpiece 2 is set in the curved shape, so that the end shape of the preform 60 is formed with gradual angle. In other words, forming the preform 60 having the curved inclined surfaces 62 prevents the contact areas between the workpiece 2 and the electrodes 20 from being formed with an acute angle. As the result of that, overconcentration of the current during the electrical heating to the workpiece 2 from the electrode 20 can be avoided, thereby ensuring the heating accuracy.

The shapes of the recess 71 and the projection 73 may be the shapes enabled of forming a surface inclined linearly or curvedly with respect to the moving direction of the clamping units 10 such as the inclined surfaces 61 and 62 formed in the preform 60.

The electrode 20 depicted in FIGS. 5 and 6 may be prepared in plural numbers around the rotation shaft 25 depicted in FIG. 4.

INDUSTRIAL APPLICABILITY

The present invention related to an electrical heating device including clamping units serving as electrodes, which clamp a workpiece to be heated from vertical direction, wherein the clamping units move in separating direction from each other during the electrical heating in order to add a tension to the workpiece.

EXPLANATION OF NUMERALS

1: electrical heating device, 2: workpiece (to be heated), 10: clamping unit, 20: electrode, 21: step portion, 22: facing surface, 30: fixed table, 40: movable table, 50: step, 60: preform, 61: inclined surface

The invention claimed is:

1. A device for electrically heating comprising a pair of clamping units serving as energizing electrodes, wherein the pair of clamping units move away from each other in a separating direction during the electrical heating so as to apply a tension to a workpiece to be heated and clamped by the pair of clamping units, each of the pair of clamping units comprises:

an electrode being movable in approaching and separating directions from the workpiece, a fixed table being immovable in a vertical direction with respect to the workpiece, but movable in a longitudinal direction of the workpiece, said vertical direction is perpendicular to the longitudinal direction of the workpiece, and a movable table, movable in both the vertical and longitudinal directions, said workpiece is mounted in a clamped position in the longitudinal direction on said tables, both of said tables face the electrode through the workpiece in the clamped position, the electrode comprises a step portion protruding toward the movable table, the movable table is disposed in the clamping unit in such a manner whereby the movable table is located closer to the corresponding counterpart clamping unit components than the fixed table is, and when the electrode moves in the approaching direction relative to the workpiece, the movable table is pressed by a protruding portion of the electrode through the workpiece and moves relatively to the fixed table, whereby a step is formed therebetween, during clamping of the workpiece by the clamping units when the electrode moves in the approaching direction relative to the workpiece, the movable table is pressed by the protruding portion of the electrode through the workpiece while the workpiece is clamped by the protruding portion of the electrode and the movable table, to thereby form the step between the movable table and the fixed table, the fixed table adding a pressure to an end of the workpiece in a direction opposite to a moving direction of the electrode and the workpiece is bent, whereby a preform including an inclined surface inclined to a plane direction of the workpiece is formed, and the inclined surface is a surface receiving the tension applied by moving the pair of clamping units away from each other in the separating direction.

2. A method for electrically heating a workpiece to be heated, using a device for electrically heating comprising a pair of clamping units serving as energizing electrodes, wherein the pair of clamping units move away from each other in a separating direction during the electrical heating so as to apply a tension to the workpiece clamped by the pair of clamping units, the method comprising:

arranging an electrode, a fixed table, and a movable table in such a manner that the electrode faces the fixed table and the movable table through the workpiece so that clamping units longitudinally clamp the workpiece, the clamping units each comprising:

the electrode including a step portion;

the fixed table, being immovable in a vertical direction with respect to the workpiece, but movable in the longitudinal direction of the workpiece, said vertical direction is perpendicular to the longitudinal direction of the workpiece;

the movable table, movable in both the vertical and longitudinal directions, the movable table being disposed in the clamping unit in such a manner whereby the movable table is located closer to the corresponding counterpart clamping unit components than the fixed table is;

moving the electrode in an approaching direction relative to the workpiece, pressing the movable table by a protruding portion of the electrode through the workpiece while clamping the workpiece by the protruding portion of the electrode and the movable table to form a step between the movable table and the fixed table, adding by the fixed table a pressure to an end of the workpiece in a direction opposite to a moving of direction of the electrode, and bending the workpiece, to thereby form a preform including an inclined surface inclined to a plane direction of the workpiece; and applying the tension to the workpiece by moving the pair of clamping units away from each other in the separating direction, wherein the inclined surface is a surface receiving the tension.

3. The device according to claim 1, wherein the movable table is movable following a vertical movement of the electrode.

* * * * *